US007863560B2

(12) United States Patent
Schaumlöffel et al.

(10) Patent No.: US 7,863,560 B2
(45) Date of Patent: Jan. 4, 2011

(54) NEBULIZER WITH NANOMETRIC FLOW RATE OF A LIQUID EFFLUENT AND NEBULIZING INSTALLATION COMPRISING SAME

(75) Inventors: Dirk Schaumlöffel, Jurançon (FR); Pierre Giusti, Pau (FR); Joanna Szpunar, Lons (FR); Ryszard Lobinski, Lons (FR)

(73) Assignees: Centre National de la Recherche Scientifique -CNRS-, Paris Cedex (FR); Universite de Pau et des Pays de l'Adour, Paris Cedex (FR)

( * ) Notice: Subject to any disclaimer, the term of this patent is extended or adjusted under 35 U.S.C. 154(b) by 300 days.

(21) Appl. No.: 11/916,396

(22) PCT Filed: Jun. 1, 2006

(86) PCT No.: PCT/FR2006/001249

§ 371 (c)(1),
(2), (4) Date: Dec. 3, 2007

(87) PCT Pub. No.: WO2006/131626

PCT Pub. Date: Dec. 14, 2006

(65) Prior Publication Data

US 2009/0014640 A1 Jan. 15, 2009

(30) Foreign Application Priority Data

Jun. 9, 2005 (FR) ..... 05 05884

(51) Int. Cl.
*H01J 49/00* (2006.01)

(52) U.S. Cl. ..... 250/288; 250/281; 239/86; 239/290; 239/416.4; 239/416.5; 239/418; 239/423; 239/424

(58) Field of Classification Search ..... 250/281, 250/288; 239/89, 290, 416.4, 416.5, 418, 239/423, 424
See application file for complete search history.

(56) References Cited

U.S. PATENT DOCUMENTS 4,865,444 A 9/1989 Green et al.
4,924,097 A 5/1990 Browner et al.

(Continued)

FOREIGN PATENT DOCUMENTS

EP 1 468 749 A1 10/2004

*Primary Examiner*—Jack I Berman
*Assistant Examiner*—Hanway Chang
(74) *Attorney, Agent, or Firm*—Miller, Matthias & Hull, LLP

(57) ABSTRACT

The invention concerns a nebuliser with nanometric flow rate of a liquid effluent in a nebulising gas comprising at least arranged substantially concentric, a capillary tube for intake of the liquid effluent and a nebulising needle including a central channel fed with liquid effluent through the capillary tube, a chamber for intake of the nebulising gas feeding a nozzle for expelling the nebulising gas, the nebulising needle passing through the intake chamber and the nozzle expelling the nebulising gas, the nebulising needle including a outlet for the liquid effluent whereof the aperture diameter is less than 20 ?m, the ratio of the diameter of the outlet of the nozzle expelling the nebulising gas and the outlet of the nebulising needle being more than 10 The inventive nanometric flow rate nebuliser and nebulising installation are applicable in mass spectrometry of trace elements contained in intracellular or microbiological medium for example.

12 Claims, 4 Drawing Sheets

U.S. PATENT DOCUMENTS 5,247,842 A 9/1993 Kaufman et al.
6,032,876 A * 3/2000 Bertsch et al. ..... 239/418
2004/0164186 A1 8/2004 Kladders et al.

* cited by examiner

NEBULIZER WITH NANOMETRIC FLOW RATE OF A LIQUID EFFLUENT AND NEBULIZING INSTALLATION COMPRISING SAME

CROSS-REFERENCE TO RELATED APPLICATION

This is the U.S. National Phase of International Application No. PCT/FR2006/001249 filed 1 Jun. 2006, which claims priority to French Patent Application No. FR 05 05884 filed 9 Jun. 2005, the entire disclosures of which is incorporated herein by reference.

FIELD OF THE DISCLOSURE

The invention relates to a nebulizer with nanoscale flow rate of a liquid effluent, in a nebulizing gas, and to a nebulizing installation comprising such a nebulizer.

BACKGROUND OF THE DISCLOSURE

Inductively coupled plasma mass spectrometry, denoted by ICP-MS, is currently the main technique used for analysis of trace elements, and also the preferred detection technique in liquid chromatography for speciation. Speciation is understood to mean the assaying of the exact chemical form in which an element is found in an analysis sample.

The main advantages of ICP-MS comprise:

a very high sensitivity;

the independence of the intensity of the signal detected with respect to the molecular structure generating the latter; and the absence of the suppression by absorption of the signal detected by the salts of the chromatographic mobile phase, which is, on the contrary, the main problem in electrospray ionization mass spectrometry.

The aforementioned characteristics make ICP-MS a potentially attractive technique for assaying trace compounds in microvolumes of biological samples such as, for example, the content of individual cells, vacuoles, or the "spots", points or bands of gel obtained by gel electrophoresis, after separation by means of chromatography at nanoscale flow rates, less than 500 nl/min for HPLC (High Performance Liquid Chromatography) columns having an inner diameter less than or equal to 100 μm.

The major problem suffered by this technique is however the unacceptable lack of operational interface, capable of introducing, without any dilution, the liquid effluent to be analyzed at flow rates of less than 1 μl/min in an efficient manner, that is to say with 100% transport into the plasma torch. It should be noted, in particular, that the introduction of a diluent has the effect of greatly reducing the strength of the signal and the sensitivity of the measurement.

Standard ICP nebulizers currently operate at flow rates of around 1 ml/min. There are nebulizers that make it possible to nebulize liquid effluents at flow rates of several μl/min, but none of the latter make it possible to nebulize effluents at nanoscale flow rates.

By way of nonlimiting example, a nebulizer of this type has been described by Patent Application EP 1 081 487. Although designed to provide nebulization of a liquid effluent in a wide range of flow rates, the minimum flow rate of liquid effluent achieved is not less than 5 to 7 μl/min. Using several elemental flows, the aforementioned nebulizer moreover makes use of a nebulizing gas in a supersonic flow regime which, due to turbulence introduced, does not allow an optimal stability of the process and of the nebulizing flow rate to be obtained.

U.S. Pat. No. 5,752,663 describes a nebulizer that makes use of a nebulizing gas in a laminar flow regime in which the outer side wall of the inner tube is beveled to reduce turbulence in the nebulizing gas and to thus form droplets of liquid effluent, or aerosol, of similar size, a size having little dispersion. Although the low size dispersion of the drops appears satisfactory, the aforementioned nebulizer does not make it possible to achieve a stable nebulization of liquid effluent at a low flow rate, of less than 1 μl/min, due to the overall dimensions of the assembly and of the abrupt transition of the outer tube, in the vicinity of the outlet orifice of the liquid effluent, site of turbulence even in laminar regime.

SUMMARY OF THE DISCLOSURE

The present disclosure solves the drawbacks of the liquid effluent nebulizers of the prior art, in order to enable the implementation of an operational interface that allows operations for specification of microbiological or intracellular media to be carried out, at liquid effluent flow rate levels broadly less than 1 μl/min, in the absence of any dilution.

One subject of the present invention is, in particular, the use of a liquid effluent nebulizer with nanoscale flow rate that makes it possible to continuously deliver a spray of this effluent over a wide range of flow rates, between around ten nanoliters per minute and one thousand nanoliters per minute, under conditions of remarkable stability, continuity and linearity, the upper limit of the flow rate possibly reaching, without limitation, a few microliters.

Another subject of the present invention is the use of an installation for nebulizing liquid effluents, by successive volume elements of liquid effluent, by sampling of this effluent, the samples of liquid effluent having an elemental volume of 10 nl or below forming these volume elements which may be delivered in a repetitive, selective and controlled manner over time, for the purpose of complex selective speciation operations in the field of biology for example due to the aforementioned remarkable stability, continuity and linearity conditions of the liquid effluent nebulizer with nanoscale flow rate that is the subject of the invention.

The nebulizer with nanoscale flow rate of a liquid effluent in a nebulizing gas, which is the subject of the invention, is remarkable in that it comprises at least, arranged approximately concentrically, a capillary tube for intake of this liquid effluent and a nebulizing needle comprising a central channel fed with liquid effluent by this capillary tube, and a chamber for intake of the nebulizing gas feeding a nozzle for expelling this nebulizing gas. The nebulizing needle passes through the intake chamber and the nozzle for expelling the nebulizing gas, and comprises an outlet orifice for this liquid effluent of which the opening diameter is less than 20 μm. The ratio of the diameter of the outlet opening of the nozzle for expelling the nebulizing gas to the outlet orifice of the liquid effluent of the nebulizing needle is greater than 10.

Another subject of the invention is an installation for nebulizing liquid effluents by successive volume elements remarkable in that it comprises at least, in series, a generator of a calibrated flow of at least one liquid effluent at a substantially continuous flow rate of less than 1 μl/min, a controlled valve that receives the calibrated flow of this liquid effluent and that makes it possible to deliver, by temporal sampling control of this calibrated flow, at least one volume element of this liquid effluent, and a nebulizer with nanoscale flow rate, according to the subject of the invention, this nebulizer with nanoscale flow rate receiving at least one volume element of at least one liquid effluent via a line for connection to the controlled valve and delivering at least one volume element of nebulized liquid effluent.

The nebulizer with nanoscale flow rate and the nebulizing installation, which are subjects of the invention, find application in the mass spectrometry of trace elements contained, for example, in an intracellular or microbiological medium.

BRIEF DESCRIPTION OF THE DRAWINGS

They will be described in detail below in relation to the drawings, in which.

DETAILED DESCRIPTION

A nebulizer with nanoscale flow rate of a liquid effluent in a nebulizing gas, according to the subject of the present invention, will now be described in connection with FIGS. 1*a* to 1*c*.

Figure 1A:
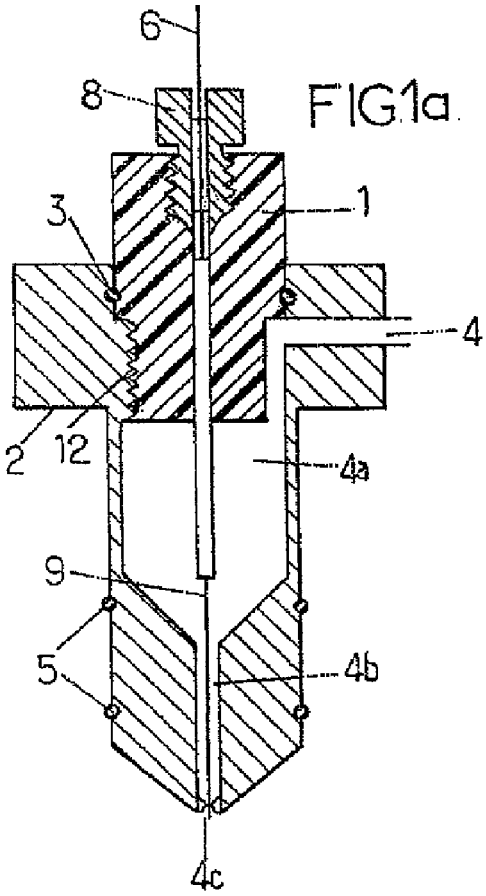
FIG. 1*a* represents, by way of illustration, a cross-sectional view along a symmetrical longitudinal cutting plane of a nebulizer with nanoscale flow rate according to the subject of the present invention.

Represented in cross section along a symmetrical longitudinal cutting plane in FIG. 1*a* is a nebulizer with nanoscale flow rate of a liquid effluent in a nebulizing gas according to the subject of the present invention.

With reference to the aforementioned figure, it is pointed out that the assembly of the constituent components of the nebulizer, which is the subject of the invention, is composed of components arranged substantially concentrically.

With reference to the aforementioned FIG. 1*a*, the nebulizer which is the subject of the invention comprises a male part 1 which is intended to be engaged in a female part 2, the male part 1 and the female part being assembled in a leaktight manner by O-rings 3.

The female part 2 comprises a line for intake of a nebulizing gas which may, for example, be composed of an inert gas such as argon or another gas. The line 4 for intake of the nebulizing gas opens into a chamber for intake of the nebulizing gas, denoted by 4*a*, the chamber for intake of the nebulizing gas comprises a nozzle for expelling the nebulizing gas.

Figure 1B:
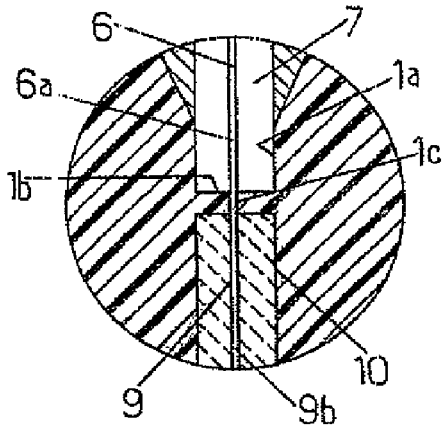
FIG. 1*b* represents, by way of illustration, a detail of the implementation of the connection of the capillary tube for intake of the liquid effluent and the nebulizing needle of the nebulizer with nanoscale flow rate that is the subject of the invention represented in FIG. 1*a;*
Figure 1C:
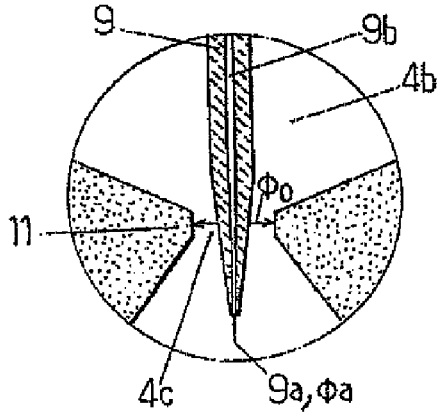
FIG. 1*c* represents, by way of nonlimiting example, a detail of the implementation of the outlet orifice of the nozzle for expelling the nebulizing gas and of the nebulizing needle of the nebulizer with nanoscale flow rate that is the subject of the invention represented in FIG. 1*a;*

The nozzle for expelling the nebulizing gas bearing the reference 4*b* is equipped with an orifice 4*c* of which a detail is represented in FIG. 1*c*.

Moreover, it can be seen in FIG. 1*a* that the external side wall of the female part 2 in the vicinity of the end of the latter and in particular on the side of the orifice 4*c* for expelling the nebulizing gas is equipped with seals 5, the function of which will be explained subsequently in the description.

Thus, as can additionally be seen in FIG. 1*a*, the male part 1 is equipped with a capillary tube 6 held, for example, in position in a bore of the male part 1 via a flexible sleeve 7, such as a polytetrafluoroethylene (PTFE), like TEFLON™ sleeve for example.

The flexible sleeve 7 and ultimately the capillary tube 6 may then be held in the manner represented by way of illustration in FIG. 1*a* via a hollow screw 8 for example.

Moreover, the male part 1 comprises, in the manner represented in the aforementioned FIG. 1*a*, a nebulizing needle 9 comprising a central channel 9*b* illustrated in detail in FIGS. 1*b* and 1*c*, this central channel being fed with liquid effluent by the capillary tube 6.

With reference to FIG. 1*a*, it is pointed out that the chamber 4*a* for intake of the nebulizing gas feeds the nozzle 4*b* for expelling the nebulizing gas. The nebulizing needle 9 passes through the intake chamber 4*a* and the nozzle 4*b* for expelling the nebulizing gas.

As has moreover been represented in FIG. 1*c*, the nebulizing needle comprises an outlet orifice 9*a* for the liquid effluent of which the opening diameter is less than 20 μm, this diameter being denoted by $\Phi_a$ in FIG. 1*c*.

Moreover, for an outlet opening diameter of the nozzle for expelling the nebulizing gas, a diameter denoted by $\Phi_o$ as represented in FIG. 1*c*, it is pointed out that according to one particularly remarkable aspect of the nebulizer with nanoscale flow rate of a liquid effluent, which is the subject of the invention, the ratio of the diameter $\Phi_o$ of the outlet opening of the nozzle for expelling the nebulizing gas to the diameter $\Phi_a$ of the outlet orifice of the nebulizing needle is advantageously greater than 10, namely $10<\Phi_o/\Phi_a$.

By choosing the ratios of the aforementioned dimensions, the diameters of the outlet opening of the nozzle for expelling the nebulizing gas and the outlet orifice of the nebulizing needle, and by supplying the chamber 4*a* for intake of the nebulizing gas, FIG. 1*a*, at a suitable pressure and the nozzle 4*b* for expelling the nebulizing gas, FIG. 1*a*, the specific arrangement of the nebulizer with nanoscale flow rate of a liquid effluent in a nebulizing gas, which is the subject of the present invention, makes it possible to create optimum flow conditions of the nebulizing gas beyond the outlet orifice 4*c* of the nozzle for expelling the nebulizing gas and to create optimum contact between the liquid effluent delivered by the orifice $\Phi_a$ of the nebulizing needle 9 as will be described hereinafter in connection with FIG. 1*c*.

With reference to the aforementioned FIG. 1*c*, it is pointed out that the outlet orifice 4*c* of the nozzle for expelling the nebulizing gas and the end of said nebulizing needle 9 form a tuyère having a venturi profile that operates substantially in a subsonic flow regime.

This objective is achieved by the fact that the end of the nebulizing needle 9 comprising the liquid effluent outlet orifice of diameter $\Phi_a$ passes through the nozzle 4*b* for expelling the nebulizing gas and is placed beyond the zone of maximum expulsion rate of the gas, in the flow direction of the nebulizing gas.

Moreover, the channel 9*b* of the needle 9 may advantageously have a diameter that decreases towards the end bearing the outlet orifice, in order to accelerate the ejection rate of the effluent, without however unacceptably increasing the pressure and the pressure drops upstream.

With reference to FIG. 1*c*, it is pointed out that the zone of maximum expulsion rate of the gas is located substantially at the level of the maximum constriction of the nozzle 4*b* for expelling the gas and in particular at the level of the opening zone corresponding to the opening diameter $\Phi_o$ previously described and represented in FIG. 1*c*.

The relative arrangement of the nebulizing needle 9 and in particular of the opening orifice of the channel 9*b* of the latter beyond the zone of maximum expulsion rate of the nebulizing gas, as represented in FIG. 1*c*, makes it possible to deliver the liquid effluent into the central zone of the flow of nebulizing gas substantially in the absence of turbulence and into a zone of substantially laminar flow. Due to this fact, the interaction between the liquid effluent delivered in the aforementioned laminar flow of the stream of nebulizing gas expelled, enables a physical interaction between the liquid effluent and the nebulizing gas causing the creation of a spray, that is to say a dispersion of the liquid effluent in very fine droplets.

Preferably, as represented, in particular, in FIGS. 1*a* and 1*b*, the capillary tube 6 and the nebulizing needle 9 are aligned and centered about the longitudinal axis of symmetry of the nebulizer symbolized in FIG. 1*a* by the capillary tube 6 and the nebulizing needle 9. The central channel 6*a* of the capillary tube 6 as represented in FIG. 1*b* and the central channel 9*b* of the nebulizing needle 9 are moreover aligned and have one and the same diameter at least equal to two times the opening diameter of the outlet orifice 9*a* of the nebulizing needle 9.

With reference to FIG. 1*b*, it is pointed out that, in addition, the capillary tube 6 and the nebulizing needle 9 are mounted in the male part 1 substantially symmetrical relative to the longitudinal axis of the nebulizer. The male part comprises for this purpose a longitudinal bore 1*a* equipped with a radial seat 1*b* for supporting and holding the capillary tube 6 and the nebulizing needle 9. The radial seat 1*b* comprises a central orifice 1*c* allowing the engagement of the capillary tube 6 and the nebulizing needle 9 and the abutment of the central channel of the latter.

The capillary tube 6 may advantageously be a silica glass capillary tube, the capillary tube 6 then being held in the male part 1 of the nebulizer and in particular in the bore 1*a* of the latter via the flexible sleeve 7 such as a polytetrafluoroethylene (PTFE), like TEFLON™ sleeve for example and the hollow screw 8, which may advantageously be made of a plastic such as polyetheretherketone (also called PEEK) fiber.

The nebulizing needle 9 is preferably composed of one and the same material as the capillary tube 6 and in particular of silica glass. The aforementioned needle may then be of the same type as that used within the context of "nanoelectrospray" technology in ESI-MS. The nebulizing needle 9 may advantageously also be held in position in the bore 1*a* of the male part 1 by means of a sleeve 10 made of a flexible material such as polytetrafluoroethylene (PTFE), like TEFLON™ and via a hollow screw made of PEEK, not represented in the drawing.

With reference to FIG. 1*b*, it is pointed out that the joining and connection of the central channel of the capillary tube 6 and of the nebulizing needle 9 is then carried out in the absence of any dead volume due to the orifice 1*c* provided in the radial seat, this orifice possibly consisting of a hole that is 600 μm long and 300 μm in diameter for example, drilled into the aforementioned radial seat.

With reference to FIG. 1*b*, it is possible to observe that the sleeves 7 and 10 made of a flexible material, in particular of polytetrafluoroethylene (PTFE), like TEFLON™, come to rest respectively against the opposite faces of the radial seat 1*b*.

Finally, with reference to FIG. 1*c*, it is pointed out that the outlet orifice 4*c* of the nozzle 4*b* for expelling the nebulizing gas is formed and comprises a rim made of a material having a high machining tolerance, this rim bearing the reference 11. The outlet orifice of the nebulizing gas may, by way of non-limiting example, then be formed by a rim made of industrial sapphire through which the nebulizing needle is introduced. The use of a rim made of a material having a high machining tolerance thus makes it possible to obtain an outlet orifice for the nebulizing gas having very accurate dimensions and a very low degree of roughness, which makes it possible to minimize the formation of turbulence in the zone of contact between the nebulizing gas expelled and the liquid effluent delivered via the outlet orifice of the nebulizing needle.

For an outlet orifice of the nebulizing needle having a diameter $\Phi_a$ of 10 μm, the diameter of the outlet orifice of the nozzle for expelling the nebulizing gas, diameter $\Phi_o$, may thus be made equal, in a ratio of 26, to 260 μm.

Preferably, as represented in FIGS. 1*a* and 1*b*, the nebulizing needle is positioned in the center of the flow in particular as regards the outlet orifice of the latter.

This position may advantageously be controlled via a microscale thread equipping on the one hand the male part 1 and respectively the female part 2, the microscale thread bearing the reference 12 in FIG. 1*a*.

Finally, the distal end of the nebulizing needle and in particular the outer wall of this has a beveled profile to form with the flared wall of the orifice for expelling the nebulizing gas the Venturi tuyère mentioned previously in the description. The angle of inclination of the beveled wall in the plane from FIG. 1*c* relative to the longitudinal axis of the nebulizing needle 9 and of the central channel 9*b* of the latter may then be made equal to a value between 10 and 30 degrees.

Figure 2:
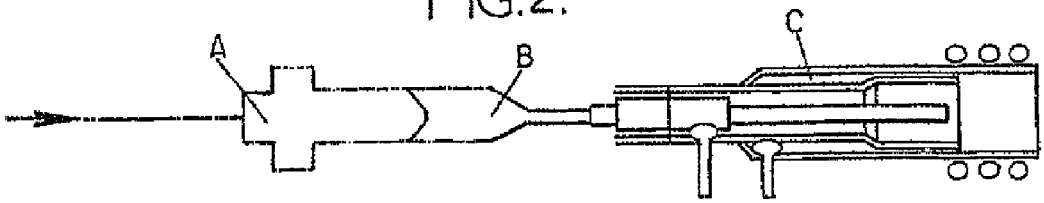
FIG. 2 represents an assembly of a nebulizer and an inductive plasma torch enabling the analysis of nebulized samples by mass spectrometry to be carried out.

In FIG. 2, an assembly of a nebulizer and an inductive plasma torch is represented that makes it possible to carry out analysis of nebulized samples by mass spectrometry.

In the aforementioned figure, A denotes a nebulizer according to the subject of the present invention such as described previously in connection with FIGS. 1*a* to 1*c* and B advantageously denotes a removable nebulizing chamber, which may be detached from the nebulizer A itself but constitute an integrative part of the latter, under the conditions hereinbelow. The nebulizing chamber B is reduced in order to minimize dead volumes which have a considerable influence on the reaction time of the set of devices in the case of transient signals.

Thus, the nebulizing chamber may be removable and is thus able to be plugged into the female part 2 of the nebulizer represented in FIG. 1*a* in a leaktight manner, the sealing during the assembly being ensured by O-rings S represented in the aforementioned FIG. 1*a*.

The nebulizing chamber comprises a nebulizing space formed, for example, by a borosilicate glass, like PYREX™ glass tube comprising, in addition, a tapered tube enabling the connection of the nebulizing space and a plasma torch within which the plasma is created to carry out the analysis by mass spectrometry. The plasma torch bears the reference C in FIG. 2.

Various guidelines and accounts of tests will now be given in connection with FIG. 3 for a nebulizer with nanoscale flow rate according to the subject of the present invention previously described in connection with FIGS. 1*a*, 1*b* and 1*c*, installed in an assembly such as represented in FIG. 2.

The results and account of tests are given in connection with FIG. 3 under the conditions hereinbelow.

The nebulizer, subject of the invention, was tested for a range of flow rates between 50 nl/min and 450 nl/min with a nebulizing gas flow rate composed of argon at a flow rate of 1.1 l/min.

Figure 3:
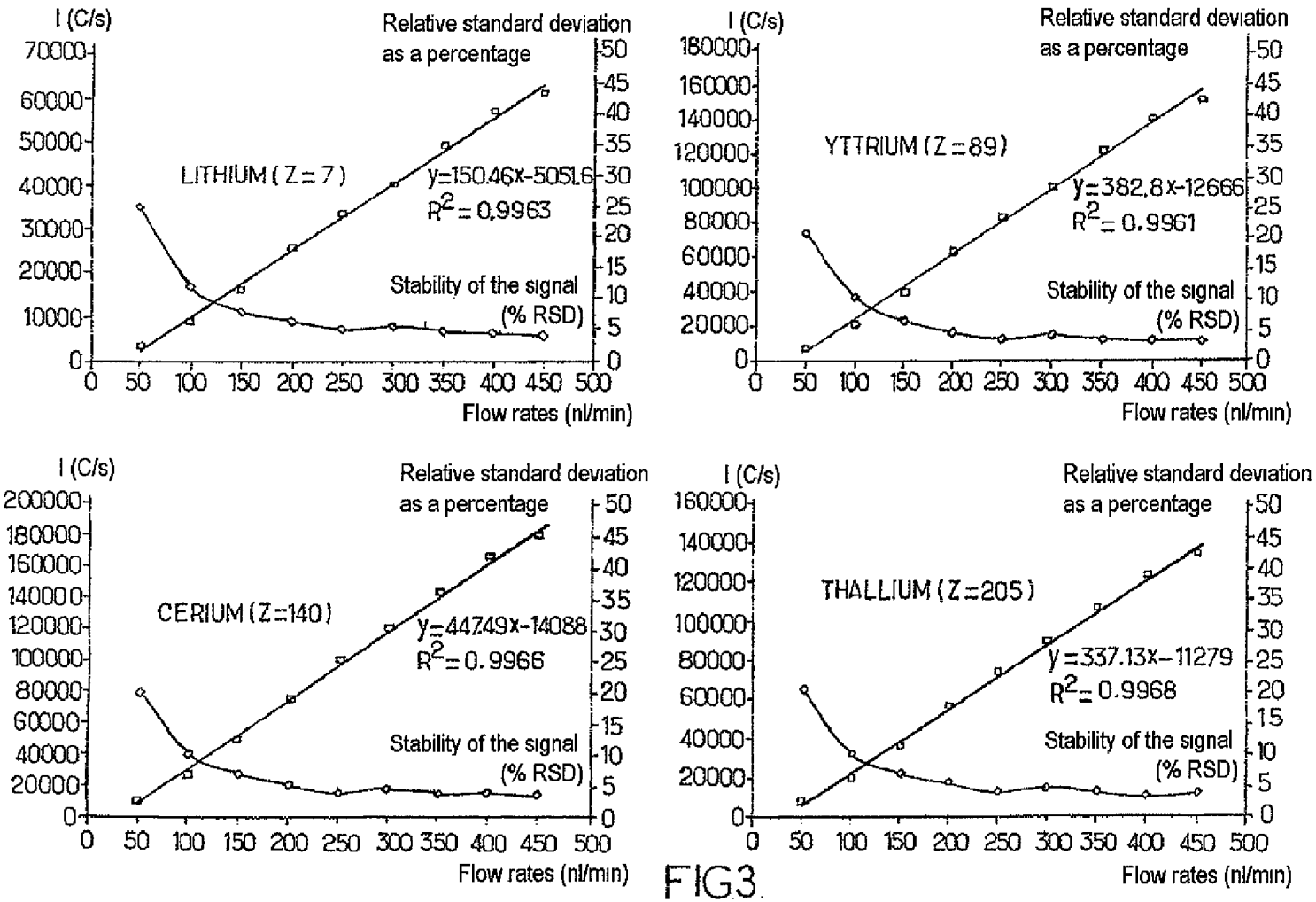
FIG. 3 represents, by way of illustration, various curves of the intensity of the signal detected in number of currents per second respectively of the stability of the signal in % RSD ( Relative Standard Deviation) as a function of the flow rate in nanoliters per minute of liquid effluent delivered by a nebulizer with nanoscale flow rate that is the subject of the invention, for elements such as lithium, yttrium, cesium and thallium, in an assembly such as represented in FIG. 2.

FIG. 3, in its four constituent graphs, represents the intensity of the signal detected by the plasma torch C, the intensity I measured in counts per second c/s on the left-hand y-axis, and the stability of the detection signal obtained in % RSD on the right-hand y-axis, as a function of the flow rate of spray injected into the plasma torch, the flow rates being expressed in nanoliters per minute, for 4 elements such as lithium (Z=7), yttrium (Z=89), cerium (Z=140) and thallium (Z=205) at a concentration of 200 ng/g (nanogram/gram) covering the weight range of the elements commonly detected using a plasma torch.

With reference to the four graphs from the aforementioned FIG. 3, it is pointed out that the stability of the signal detected is better than 7% for spray effluent flow rates between 150 and 450 nl/min.

Moreover, for the four aforementioned graphs, it is pointed out that the linearity represented by the linear regression of the intensity of the signal in counts per second as a function of the flow rate in nanoliters per minute is better than 4/1000, perfect linearity being obtained for $R^2=1$.

The aforementioned tests have shown that, for the previously mentioned test flow rate range, the amount of doubly charged ions and also the amount of oxide obtained after nebulization at nanoscale flow rate remains very low.

The aforementioned tests have shown that the degree of formation of these oxides and of these ions, as a function of the flow rate for cerium (Z=140), are better than 0.4% for the degree of formation of oxide $CeO^+$ and better than 2.0% for the degree of formation of doubly charged ions $Ce^{2+}$.

It is recalled that the aforementioned amounts of doubly charged ions and oxides obtained after nebulization are of prime importance for characterizing a nebulizer, as the oxides and the doubly charged ions are typical interference elements which it is important to minimize in order to increase the intensity of the signal detected.

A more detailed description of an installation for nebulizing liquid effluents by successive volume elements, according to the subject of the present invention, will now be given in connection with FIG. 4.

With reference to the aforementioned figure, it is pointed out that the installation for nebulizing liquid effluents, which is a subject of the invention, is remarkable in that it comprises at least, in series, a generator G of a calibrated flow of at least one liquid effluent at a substantially continuous flow rate of less than 1 μl/min and a controlled valve V that receives the calibrated flow of liquid effluent and that makes it possible to deliver, by temporal sampling control of this calibrated flow, at least one volume element of this liquid effluent. A nebulizer A with nanoscale flow rate, according to the subject of the present invention, is connected to the controlled valve V and receives at least one volume element of at least one liquid effluent via a line for connection to the controlled valve and delivers at least one volume element of nebulized liquid effluent. Each liquid effluent volume element is integrated with a concentration gradient in the continuous flow of eluent.

Figure 4:
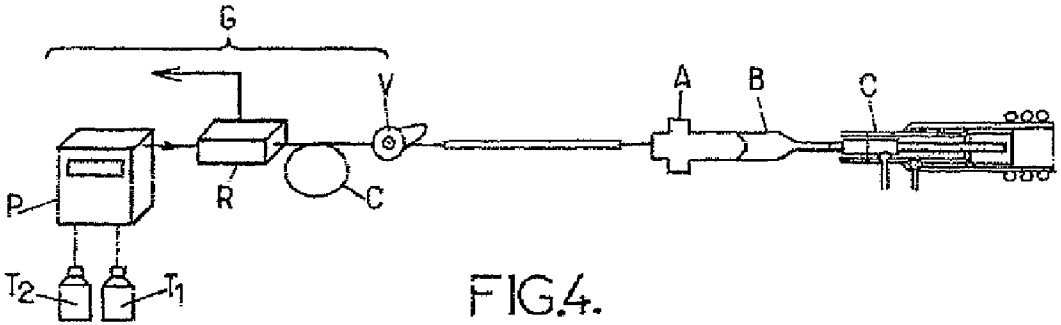
FIG. 4 represents, by way of illustration, a nebulizing installation incorporating a nebulizer with nanoscale flow rate according to the subject of the invention.

It is understood, in particular with reference to FIG. 4, that the generator G of a calibrated flow of at least one liquid effluent comprises at least a high-pressure pump P selectively fed by a plurality of different liquid effluents, the high-pressure pump delivering a substantially continuous flow at high pressure and at a set flow rate of one of the liquid effluents. For this purpose, the pump P may be connected to a plurality of effluent tanks denoted $T_1$ and $T_2$, each effluent possibly being chosen selectively.

Moreover, as represented in FIG. 4, the generator G may comprise a liquid effluent flow restrictor R that makes it possible to deliver from the substantially continuous flow delivered by the pump P, a reduced flow at a set flow rate ratio of the liquid effluent.

In one nonlimiting embodiment, for a pump P that delivers a flow rate of effluent at 100 μl/min, the liquid effluent flow restrictor is a flow restrictor that makes it possible to bring the afore-mentioned flow rate of 100 μl/min to the value of 0.3 μl/min.

A flow calibrator C thus makes it possible to deliver from the reduced flow of the liquid effluent, a calibrated flow of liquid effluent of which the flow rate does not exceed 0.5 μl/min. The flow calibrator C is not essential for lower flow rates.

Preferably, and taking into account a judicious choice of the controllable valve V, each liquid effluent volume element may advantageously represent a volume of 10 nl.

Thus, the use of the aforementioned controlled valve and of a liquid chromatography column having an inner diameter of 75 μm, the aforementioned column making it possible to connect the controlled valve V to the nebulizer A, thus makes it possible to use and to characterize the nebulizer with nanoscale flow rate that is the subject of the invention in the case of a transient signal and regime. This transient signal may result from the detection of a volume element transmitted by the controlled valve V.

Figure 5A:
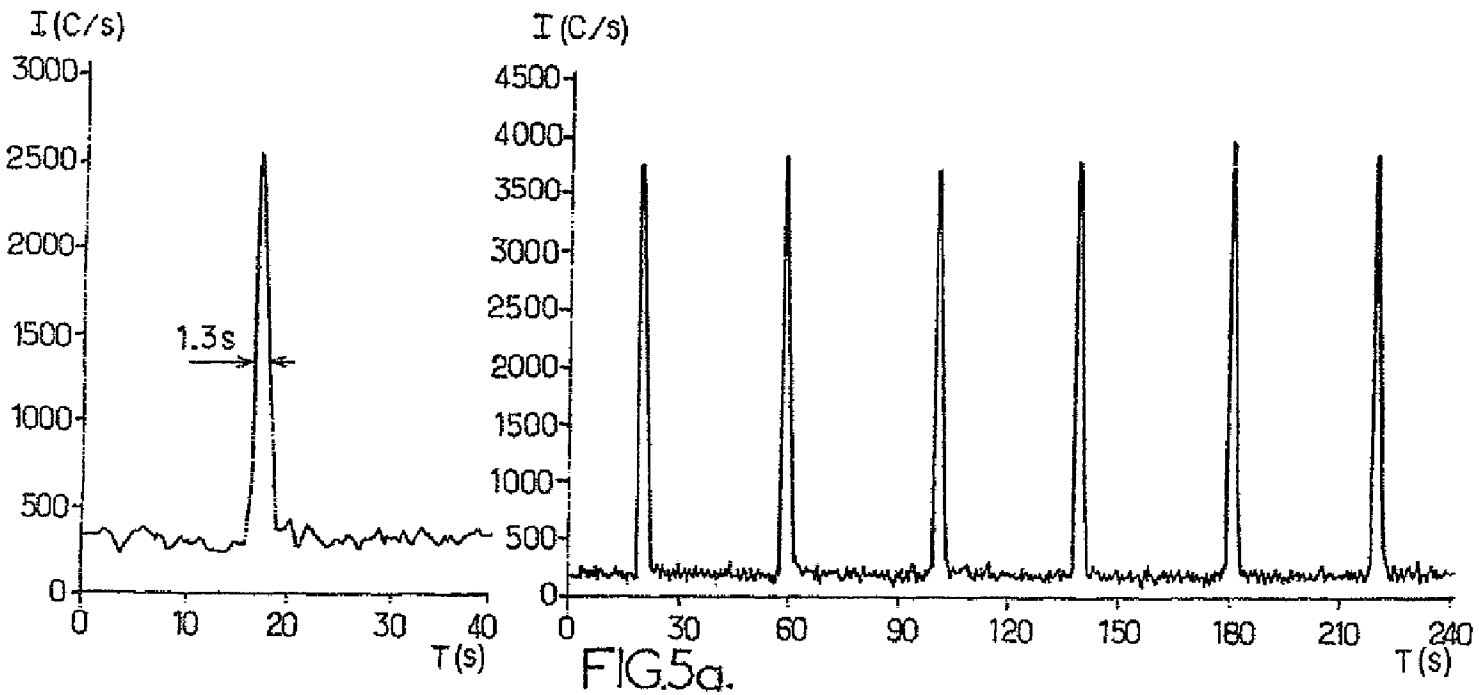
FIG. 5*a* represents, by way of illustration, timing diagrams for detection of a liquid effluent containing 600 femtograms of selenium in the form of selenomethionine eluted by 30% of acetonitrile in water in isocratic mode at 300 nl/min and the repetition of successive injections of 1 picogram of selenium in the form of selenomethionine contained in 10 nl of this liquid effluent.

FIGS. 5*a* to 5*d* make it possible, in particular, to display the signals detected in the form of peaks represented in FIG. 5*a* especially.

FIG. 5*a* represents the signal detected in the form of a peak profile corresponding to 600 femtograms of selenium in the form of selenomethionine eluted by 30% of acetonitrile in water in isocratic mode with a spray flow rate of 300 nl/min and the reproduction of injections of 1 picogram of such a liquid effluent, due to a nebulizing installation such as represented in FIG. 4.

The peaks obtained represented in FIG. 5*a* are substantially symmetrical, these peaks being represented as intensity of counts per second cls on the y-axis, and respectively as time in seconds on the x-axis, and have a typical Gaussian profile.

The importance of the sharpness of the peaks comes from the direct connection of the latter with the resolution of the analytical device formed by the nebulizing installation represented in FIG. 4 connected of course to an inductive plasma torch. The resolution takes into account the ability of the installation to separate two compounds in a given time. In order to characterize the width of the peaks at mid-height, namely a width of 1.3 seconds represented in FIG. 4, this value appears most relevant.

For comparison and in order to take into account the gain in the separating power of the nebulizing installation, such as described in FIG. 4, it is simply recalled that in conventional liquid chromatography, that is to say for columns having an inner diameter of 4.6 mm, the typical width of peaks at mid-height is 15 seconds. A factor of 10 may thus easily be gained in the analysis time due to the use of an installation according to the subject of the present invention, such as represented in FIG. 4.

The reproducibility of the analysis may be characterized by the relative deviation over the areas of the peaks for a series of successive injections of one and the same sample as represented in the same FIG. 5*a*. With reference to the aforementioned figure, this deviation does not exceed 5% despite a baseline noise of the signal having a relative standard deviation of 3.5%.

Figure 5B:
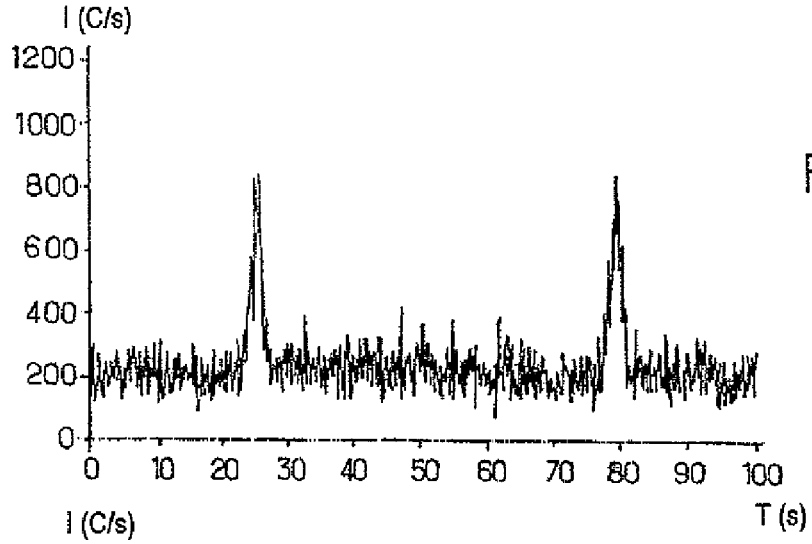
FIG. 5*b* represents, by way of illustration, the detection limit corresponding, by definition, to the concentration of selenomethionine equivalent to a peak of which the height or intensity in counts per second is approximately three times higher than the standard deviation of the baseline noise.

FIG. 5*b* makes it possible to evaluate the sensitivity limit for selenium of a nebulizing installation such as represented in FIG. 4.

The sensitivity limit of detection corresponds, by definition, to the concentration equivalent to a detected peak of which the height will be three times, for example, the standard deviation of the baseline noise, as represented in FIG. 5*b*.

The relative detection limit for the nebulizing installation such as represented in FIG. 4 is 2.4 ng/g (nanograms per grams). This in fact corresponds to an absolute detection limit of 25 femtograms, i.e. the lowest sensitivity limit of detection ever achieved in liquid chromatography/ICP-MS coupling for selenium. It is recalled that one femtogram=$10^{-15}$ g.

Figure 5C:
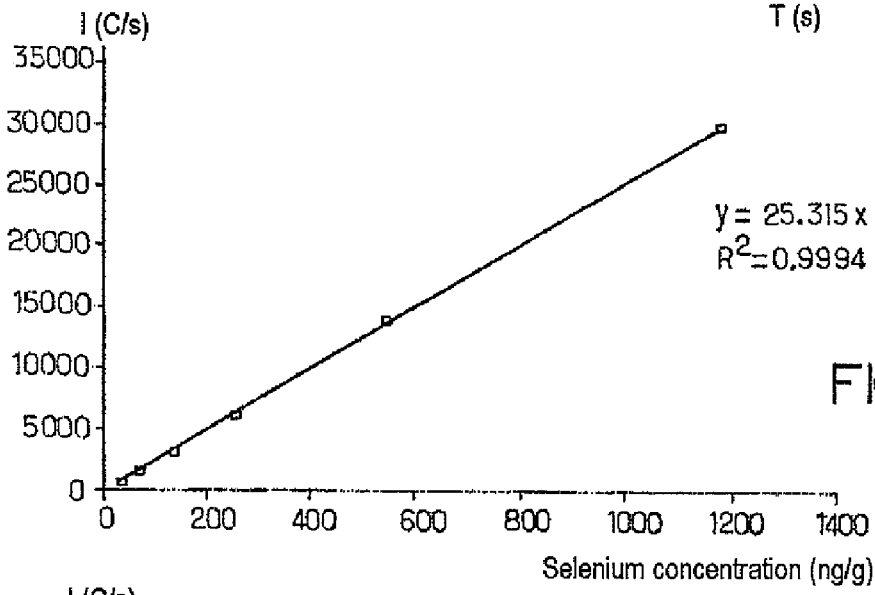
FIG. 5*c* represents, by way of illustration, the area of the detection peaks obtained as a function of the nebulized concentration obtained for an isocratic flow rate of liquid effluent $H_2O$ (70%)/$CH_3CN$ (30%) set at 300 nl/min, by injecting 10 nl of a selenomethionine standard at various concentrations.

Finally, the linearity of the response is represented by the linear regression from FIG. 5*c* of the area of the peaks obtained as a function of the nano-nebulized concentration. In the aforementioned figure, the y-axis is graduated as intensity I of the signal detected in counts per second c/s and the x-axis in concentration of selenium in nanograms per gram. The curve represented in FIG. 5*c* was obtained for an isocratic flow rate $H_2O$ (70%)/$CH_3CN$ (30%) set at 300 nl/min, by injecting 10 nl of a selenomethionine standard at various concentrations. It is pointed out that the aforementioned volume of 10 nl corresponds to a liquid effluent volume element injected thanks to the installation used according to the installation that is the subject of the invention represented in FIG. 4.

With reference to FIG. 5*c*, it can be seen that the regression coefficient $R^2$=0.9994 having a lack of linearity as low as $6\times10^{-4}$ demonstrates the particularly remarkable linearity of the response of the nebulizing installation according to the subject of the present invention, such as represented in FIG. 4 and the accuracy which results therefrom.

Figure 5D:
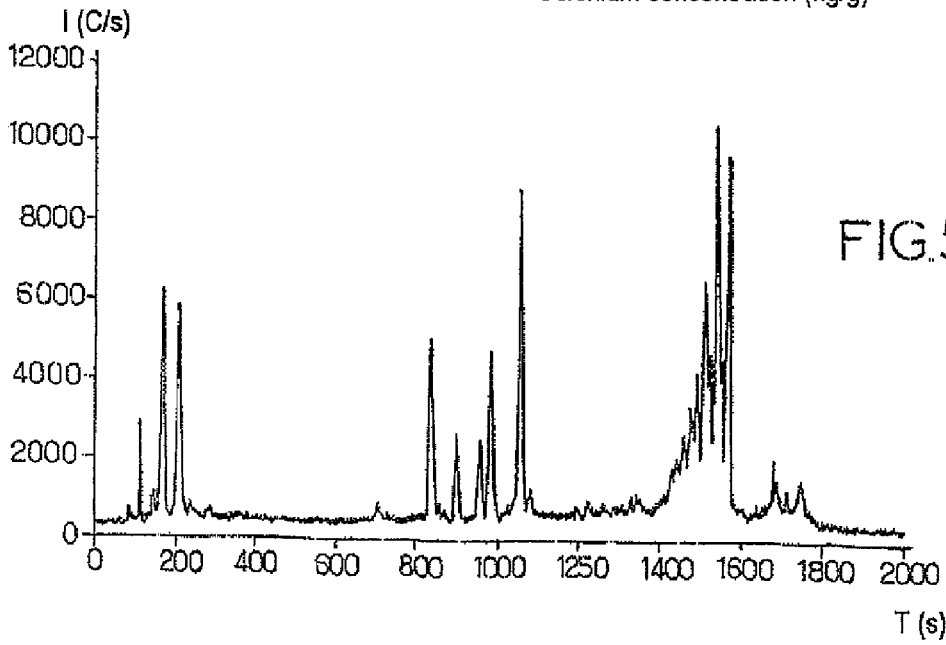
FIG. 5*d* represents a timing diagram of intensity in number of counts as a function of the time in seconds obtained due to the nebulizing installation, which is the subject of the invention, coupled to an ICP-MS torch on an analysis sample formed by an elemental volume of 10 nl of a tryptic digest of selenium-containing protein.

FIG. 5*d* represents a chromatogram that makes it possible to test the actual results on a real sample of 10 nl of a tryptic digest of selenium-containing protein, analyzed thanks to a nebulizing installation, such as represented in FIG. 4, coupled to an inductive plasma torch for mass spectrometry.

To carry out the aforementioned test, the gradient of acetonitrile in water used was the following:

Flow rate: 365 nl/min;
0-1 min 5% B isocratic;
1-9 min 10-22% B linear;
9-16 min 22-45% B linear;
16-18 min 45-90% B linear;
18-20 min 90% B isocratic; and
20-21 min 90-95% B linear.

With reference to FIG. 5*d*, it is pointed out that the separation obtained is better than in conventional chromatography due to the sharpness of the peaks, and that the total analysis time is no longer than 30 min, whereas 80 min were previously required during the use of a conventional HPLC/ICP-MS.

It is understood, in particular, that the procedure for carrying out the analysis of the digest of selenium-containing protein represented in FIG. 5*d* is obtained by the use of a process for analyzing elements present as traces in an analysis sample of liquid effluents by inductively coupled plasma mass spectrometry, particularly remarkable in that it consists in generating, from a continuous flow of liquid effluent, a spray of liquid effluent to be analyzed at a flow rate between 10 nl/min and 600 nl/min, and then in introducing the spray forming the analysis sample into an inductively coupled plasma torch to carry out the analysis of the aforementioned analysis sample by mass spectrometry.

Of course, as described previously in relation to the procedure of the nebulizing installation in connection with FIG. 4, the process consists in sampling the continuous flow of liquid effluents by volume elements of liquid effluent having a volume substantially equal to 10 nl.

The nebulizer with nanoscale flow rate of the nebulizing installation comprising such a nebulizer and the analysis process according to the subject of the present invention make it possible to obtain a better resolution, a saving in the samples and eluent due to the reduction in the sizes of the assembly of the nebulizing installation and also a very large reduction in the analysis time due to the introduction of a spray flow rate less than one microliter per minute into the inductive plasma torch.

The invention claimed is:

1. A nebulizer with nanoscale flow rate of a liquid effluent in a nebulizing gas, said nebulizer including at least, arranged approximately concentrically:

a capillary tube for intake of said liquid effluent and a nebulizing needle comprising a central channel fed with liquid effluent by said capillary tube; and a chamber for intake of said nebulizing gas feeding a nozzle for expelling said nebulizing gas, said nebulizing needle passing through said intake chamber and said nozzle for expelling said nebulizing gas, said nebulizing needle comprising an outlet orifice for said liquid effluent of which the opening diameter is less than 20 μm, the ratio of the diameter of the outlet opening of said nozzle for expelling the nebulizing gas to the outlet orifice of the nebulizing needle being greater than 10, wherein said capillary tube and said nebulizing needle are mounted in a male part, substantially symmetrical relative to a longitudinal axis of said nebulizer, said male part comprising a longitudinal bore equipped with a radial seat for supporting and holding said capillary tube and said nebulizing needle, said radial seat comprising a central orifice allowing the engagement of said capillary tube and said nebulizing needle and the abutment of the central channel of the latter, and wherein said capillary tube and said nebulizing needle are held in position centered within said bore via sleeves made of a flexible material that rest respectively against the opposite faces of said radial seat.

2. The nebulizer as claimed in claim 1, wherein the outlet orifice of the nozzle for expelling the nebulizing gas and the end of said nebulizing needle form a nozzle having a Venturi profile that operates in a subsonic flow regime, the end of said nebulizing needle comprising the outlet orifice for said liquid effluent, passing through said nozzle, being placed beyond the zone of maximum expulsion rate of the gas, in the flow direction of the nebulizing gas, which makes it possible to deliver said effluent into the central zone of the flow of nebulizing gas, in the absence of turbulence and in substantially laminar flow of said nebulizing gas.

3. The nebulizer as claimed in claim 1, wherein said capillary tube and said nebulizing needle are aligned and centered about the longitudinal axis of symmetry of the nebulizer, the central channel of said capillary tube and of the nebulizing needle being aligned and having one and the same diameter at most equal to two times the opening diameter of the outlet orifice of said nebulizing needle.

4. The nebulizer as claimed in claim 1, wherein the sleeve for holding said capillary tube and said capillary tube are held in said bore via a hollow screw.

5. The nebulizer as claimed in claim 1, wherein said intake chamber and said nozzle for expelling said nebulizing gas are placed in a female part, approximately symmetrical relative to the longitudinal axis of symmetry of said nebulizer, said male part being mounted in said female part, said nebulizing needle passing through said intake chamber and said nozzle for expelling said nebulizing gas.

6. The nebulizer as claimed in claim 5, wherein said male part is mounted in said female part via a microscale thread engaging the male part and the female part, which makes it possible to control, by screwing, the overrun distance of the outlet orifice of said nebulizing needle with respect to the outlet orifice of said nozzle for expelling said nebulizing gas.

7. The nebulizer as claimed in claim 5, including, in addition, a removable nebulizing chamber, said nebulizing chamber being able to be plugged into said female part in a leak-tight manner and comprising at least:

a nebulizing space of which the internal diameter is approximately equal to the external diameter of said female part; and a tapered coupling tube communicating with said nebulizing space and comprising an end fitting for coupling to an ICP-MS torch.

8. The nebulizer as claimed in claim 1, wherein the outlet orifice of said nozzle for expelling said nebulizing gas comprises a rim made of a material having a high machining tolerance.

9. An installation for nebulizing liquid effluents in increments of successive volumes, said installation including at least, in series:

a generator of a calibrated flow of at least one liquid effluent at a substantially continuous flow rate of less than 1 μl/min;

a controlled valve that receives said calibrated flow of this liquid effluent and that makes it possible to deliver, by temporal sampling control of this calibrated flow, at least one volume element of this liquid effluent; and a nebulizer with nanoscale flow rate, including at least, arranged substantially concentrically:

a capillary tube for intake of said liquid effluent and a nebulizing needle comprising a central channel fed with liquid effluent by said capillary tube; and a chamber for intake of said nebulizing gas feeding a nozzle for expelling said nebulizing gas, said nebulizing needle passing through said intake chamber and said nozzle for expelling said nebulizing gas, said nebulizing needle comprising an outlet orifice for said liquid effluent of which the opening diameter is less than 20 μm, the ratio of the diameter of the outlet opening of said nozzle for expelling the nebulizing gas to the outlet orifice of the nebulizing needle being greater than 10, said nebulizer receiving at least one volume element of at least one liquid effluent via a line for connection to said controlled valve and that delivers at least one volume element of nebulized liquid effluent, wherein said generator of a calibrated flow of at least one liquid effluent comprises at least:

a high-pressure pump selectively fed by a plurality of different liquid effluents, said high-pressure pump delivering a substantially continuous flow at high pressure and at a flow rate greater than 50 μl/min of one of said liquid effluents;

a liquid effluent flow restrictor that makes it possible to deliver from said substantially continuous flow delivered by the pump, a reduced flow at a set flow rate ratio of this liquid effluent; and a flow calibrator that delivers from the reduced flow of said liquid effluent less that 0.5 μl/min.

10. The installation as claimed in claim 9, wherein each volume element of said liquid effluent has a volume of 10 nl.

11. A method for analyzing elements present as traces in an analysis sample of liquid effluent, by inductively coupled plasma mass spectrometry, said method consisting at least in:

providing a nebulizer including at least, arranged approximately concentrically, a capillary tube and a nebulizing needle comprising a central channel fed with the liquid effluent by said capillary tube; and a chamber for intake of a nebulizing gas feeding a nozzle for expelling said nebulizing gas, said nebulizing needle passing through said intake chamber and said nozzle for expelling said nebulizing gas, said nebulizing needle comprising an outlet orifice for said liquid effluent of which the opening diameter is less than 20 μm, the ratio of the diameter of the outlet opening of said nozzle for expelling the nebulizing gas to the outlet orifice of the nebulizing needle being greater than 10, wherein said capillary tube and said nebulizing needle are mounted in a male part, substantially symmetrical relative to a longitudinal axis of said nebulizer, said male part comprising a longitudinal bore equipped with a radial seat for supporting and holding said capillary tube and said nebulizing needle, said radial seat comprising a central orifice allowing the engagement of said capillary tube and said nebulizing needle and the abutment of the central channel of the latter, and wherein said capillary tube and said nebulizing needle are held in position centered within said bore via sleeves made of a flexible material that rest respectively against the opposite faces of said radial seat, generating, through the nebulizer and from a continuous flow of liquid effluent, a spray of liquid effluent to be analyzed at a flow rate between 10 nl/min and 600 nl/min; and introducing said spray forming the analysis sample into an inductively coupled plasma torch to carry out the analysis by mass spectrometry of the analysis sample.

12. The method as claimed in claim 11, said method consisting in sampling said continuous flow of liquid effluent by elemental volume elements of liquid effluent having a volume substantially equal to 10 nl , and forming an analysis sample composed of at least one spray formed from at least one elemental volume.

* * * * *